US005230164A

United States Patent [19]

Kishi

[11] Patent Number: 5,230,164

[45] Date of Patent: Jul. 27, 1993

[54] RAW SEWAGE DISPOSAL APPARATUS

[75] Inventor: Mitsuhiro Kishi, Tochigi, Japan

[73] Assignee: Japanic Corporation, Tochigi, Japan

[21] Appl. No.: 784,541

[22] Filed: Oct. 29, 1991

[30] Foreign Application Priority Data

Jul. 3, 1991 [JP] Japan ..... 2-189281

[51] Int. Cl.[5] ..... F26B 19/00

[52] U.S. Cl. ..... 34/60; 34/95; 34/179; 4/111.1

[58] Field of Search ..... 34/95, 179, 181, 60, 34/71; 4/111.1, 111.5, 111.6, 449

[56] References Cited

U.S. PATENT DOCUMENTS

| | | | |
|---|---|---|---|
| 2,279,578 | 4/1942 | Martin | 4/111.3 |
| 2,784,499 | 3/1957 | Andersen | 34/95 |
| 4,521,304 | 6/1985 | Yount | 4/111.1 |
| 4,999,930 | 3/1991 | Kishi et al. | 34/95 |
| 5,058,213 | 10/1991 | Kishi et al. | 34/95 |

*Primary Examiner*—Henry A. Bennet
*Assistant Examiner*—Denise Gromada
*Attorney, Agent, or Firm*—Flynn, Thiel, Boutell & Tanis

[57] ABSTRACT

A raw sewage disposal apparatus, such as a portable toilet. The apparatus has a vessel with a first introduction pipe for feeding raw sewage into the vessel. The vessel is externally heated and contains heat holding bodies and an agitator so that the sewage can be heated to evaporate liquid therefrom while being agitated to break down nonevaporable substances into powder. A second introduction pipe is provided to circulate air through the vessel to remove the vapor and later the power therefrom. A deodorizing means including a catalyst, and a preheater for preheating the catalyst, are provided to treat the vapor to make it substantially odorless. A third introduction pipe is provided for supplying fresh air to the preheater. A dust collector is provided to collect the powder.

12 Claims, 12 Drawing Sheets

RAW SEWAGE DISPOSAL APPARATUS

BACKGROUND OF THE INVENTION

1. Field of the Invention

The present invention relates to a raw sewage disposal apparatus for disposing of raw sewage, which apparatus can be utilized in the outdoors, in a transportation means, such as a vessel or train, or in a tunnel through which a tank truck used for collecting raw sewage (hereinafter referred to as a vacuum truck) cannot go and, more particularly, to an apparatus provided with a dust collector capable of removing the dust that remains in the apparatus after drying the raw sewage and a heating means for heating catalyst means, said apparatus being capable of withstanding long use and facilitating maintenance and inspection thereof.

2. Description of the Prior Art

The raw sewage discharged from a human body is typically discharged into a sewage system by use of a flush toilet and the like, and thence into a river, after being temporarily stored in a holding tank and purified therein. However, at events, such as festivals, athletic events, fairs, meetings and the like, temporary toilet facilities must be provided to dispose of raw sewage.

Employed conventionally are movable (portable) temporary toilets, most of which have a tank for temporarily storing the raw sewage therein. However, the temporary toilets have a problem in that the raw sewage stored in the tank is sucked into a vacuum truck for collection, which is laborious and maintenance of them, after they are used, is time consuming and is nonhygienic.

Transportation vehicles, such as buses, trains, vessels, etc. which operate over long distances are provided with a tank exclusively used for storing and holding the raw sewage. The raw sewage in this tank is subjected to a deodorizing treatment by chemicals, and thereafter is collected by a vacuum truck.

As mentioned above, the raw sewage in the conventional temporary toilets or the movable transportation facilities is at first stored as it is discharged from the human body and then is collected thereafter. Accordingly, the storing method, the collection method and the disposal method all are not modern and very nonhygienic.

In an attempt to ameliorate the above problems, there have been proposed several hygienic disposal methods. In one method, for example, chemicals are introduced into the tank where the raw sewage is stored to thereby prevent the bad smell and to effect sterilization of the raw sewage. This is mainly employed in the transportation industry, such as on trains like the Shinkansen Express in Japan. This method, however, cannot be used for a long period of time because the chemicals become diluted and the costs are high.

In another method, the raw sewage is stored in a bag made of vinyl and the like to prevent diffusion of the bad smell. This method, however, requires a vinyl bag of large size and involves high cost for disposal thereof, and it is troublesome to separate the raw sewage from the bag.

In still another method, the discharged raw sewage is directly dried by use of heat from a burner, etc. Since the primary component of raw sewage is liquid, a large amount of heat energy is required to remove the liquid and it takes a long time to effect disposal of the raw sewage.

In view of the drawbacks of the conventional methods for disposing of raw sewage, the present inventor proposed a drying apparatus having a casing provided with stirring blades and heat holding bodies therein in which the raw sewage is stirred by the rotation of the stirring blades and heated by heat generated by the heat holding bodies whereby the raw sewage is dried in a short period of time. This is disclosed in Japanese Patent Laid-Open Publication Nos. 63-124150, 63-172852, 63-190857, 63-292789 and Application No. 63-198858, corresponding to U.S. patent application Ser. No. 351,029, filed May 12, 1989, now U.S. Pat. No. 4,999,930, issued Mar. 19, 1991. Another related application is U.S. Ser. No. 575,910, filed Aug. 29, 1990. According to the proposed disposal methods, the raw sewage is heated in a casing and the liquid component of the raw sewage is vaporized and diffused into the ambieht atmosphere. Before the vaporized liquid component is diffused, components which cause a bad smell are treated by the catalyst and then the vaporized liquid component is diffused into the atmosphere as an odorless vapor. It is preferable to employ such a method in view of environmental hygiene and preservation even if such method is employed around crowded buildings and occasions having throngs of people.

The elimination of the bad smell has been effected in an airtight casing. In the airtight casing, nonflammable residual substances, which are small portions of the total liquid component, remain in the casing, although most of the liquid component can be vaporized. It was necessary to remove the residual substances or dusts present in the casing. To remove such residual substances and clean the casing, the casing was disassembled so that the inside of the casing was exposed. There was a problem in that it was laborious to disassemble, clean and reassemble the casing, and the temporary toilet could not be used while the casing was undergoing disassembly, cleaning and assembly operations.

Furthermore, it was necessary that the vapor should pass through the catalyst to eliminate the odor-causing substances, such as ammonia, urea and the like, which are generated during heating of the liquid component of the raw sewage. Bad smell generating components were subjected to oxidation-reduction and were thereby rendered odorless and then they were diffused in the atmosphere. As the catalyst, precious metals, such as platinum, have been typically employed. Such a catalyst should be always kept at a constant temperature exceeding a predetermined value for subjecting the bad smell generating components to oxidation-reduction. In my companion application U.S. Ser. No. 07/784595 corresponding to Japanese-Serial Nos. 164594/90, 411577/90, 67538/91 and 189280/91, a secondary heater is disposed in a passage between an evaporation cauldron and the catalyst means and always heats the catalyst to keep the temperature of the catalyst constant. When the temperature of the vapor evaporated from the evaporation cauldron is reduced during the flow thereof and contacts the catalyst at such a lower temperature, the catalyst cannot effectively perform the oxidation-reduction. Accordingly, the vapor evaporated from the evaporation cauldron is reheated by the secondary heater, its temperature is increased and thereafter it contacts the catalyst.

If the vapor, including ammonia and urea, directly contacts the secondary heater, the secondary heater is oxidized by the components of the vapor which causes breakage and erosion of the secondary heater. These disadvantages are not desired because they increase the required maintenance of the heater. It is necessary that the secondary heater can be used for a long time.

SUMMARY OF THE INVENTION

It is a first object of the present invention to provide a raw sewage disposal apparatus capable of eliminating residual substances and cleaning the casing without disassembling the casing.

It is a second object of the present invention to provide a raw sewage disposal apparatus capable of preventing the secondary heater from being oxidized or deteriorated by the components of the vapor and assuring that the secondary heater can be used for a long time.

A first aspect of the present invention provides a raw sewage disposal apparatus comprising a heat-resistant casing for containing raw sewage, a heating means for heating the casing, a drive means provided over the casing and having a stirring means fixed thereto and extending into the casing, a plurality of heat holding bodies which are heated and contained in the casing, an air introduction pipe connected to a part of the casing for introducing fresh air into the casing, an air discharge pipe connected at one end thereof to a part of the casing for discharging air from the casing, a cyclone dust collector connected to another end of the discharge pipe for separating air from the dust and a catalyst means connected to the discharge pipe.

A second aspect of the present invention provides a raw sewage disposal apparatus comprising a heat-resistant casing for storing raw sewage, a heating means for heating the casing, a drive means provided over the casing and having a stirring means fixed thereto and extending into the casing, a plurality of heat holding bodies which are heated and contained in the casing, an air introduction pipe connected to a part of the casing for introducing fresh air into the casing, an air discharge pipe connected at one end thereof to a part of the casing for discharging air from the casing, a cyclone dust collector connected to another end of the discharge pipe for separating air from the dust, a reheating means including a secondary heater connected to the air introduction pipe, an ejector connected at one end to an output of the secondary heater means for generating negative pressure and connected at the other end to the catalyst means and a bypass path having a closing valve and provided between a negative pressure side of the ejector and the discharge pipe.

DESCRIPTION OF THE PREFERRED EMBODIMENTS

First Embodiment (FIGS. 1 to 6)

Figure 1:
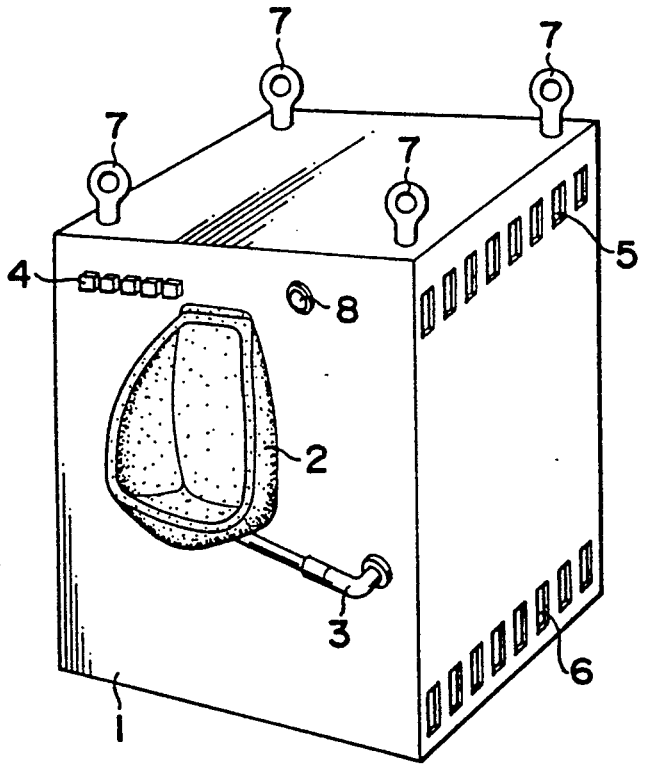
FIG. 1 is a perspective view of a temporary (i.e., portable) toilet employing a raw sewage disposal apparatus according to a first embodiment of the present invention.
Figure 2:
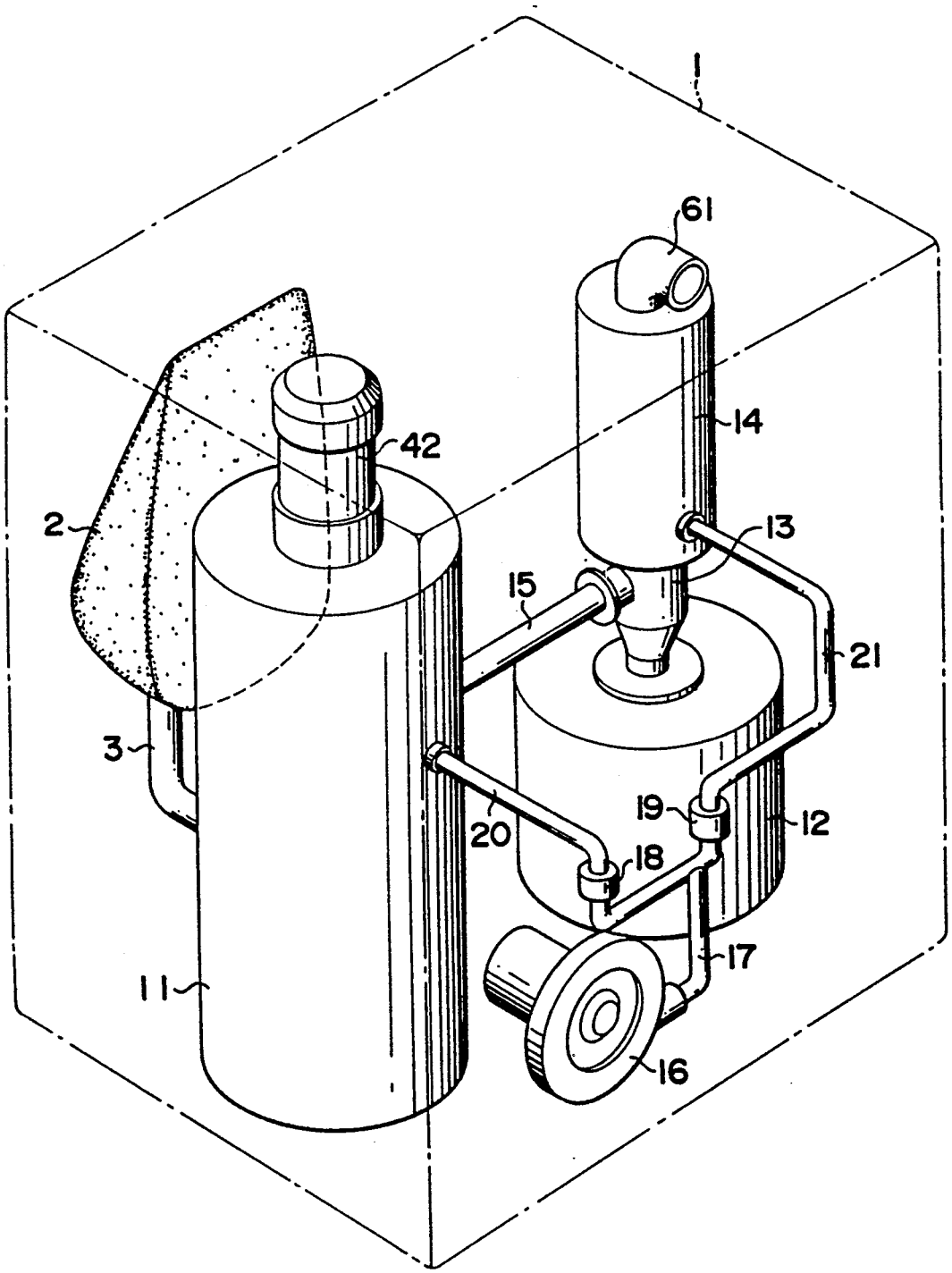
FIG. 2 is a perspective view showing the internal structure of FIG. 1.

A raw sewage disposal apparatus according to a first embodiment will be described with reference to FIGS. 1 to 6.

The raw sewage disposal apparatus can be suspended by a crane and the like and is movable by a truck and the like.

The raw sewage disposal apparatus (hereinafter referred to simply as the apparatus) has the external shape of a cube, it is formed by bending a steel plate and its interior is hollow. The apparatus 1 can carry out a series of raw sewage processing steps, such as storing, evaporating and deodorizing of the liquid component of the raw sewage. The apparatus 1 comprises a single unit which can be conveyed to a construction site, a sports event and the like and operated independently.

The apparatus 1 has a stool 2 at one side thereof for receiving urine discharged from the human body. An introduction pipe 3 is connected at one end thereof to the lower side of the stool 2 and at the other end thereof to a liquid evaporator 11, to be described later. A plurality of vents 5 and 6 are defined on side surfaces of the apparatus 1 at the upper and lower portions thereof for ventilation of the interior thereof. Hooks 7 are fixed to the upper surface thereof at the four corners thereof so that the apparatus 1 can be hung by a crane and can be moved to the appropriate location.

The apparatus 1 comprises the cylindrical liquid evaporator 11, a cylindrical collection box 12 connected to the liquid evaporator 11 by means of a discharge pipe 15, a cyclone dust collector 13 (hereinafter referred to as simply dust collector) disposed over the collection box 12 and a deodorizing unit 14. An air blower 16 is disposed in association with the liquid evaporator 11 and an air introduction pipe 17 is connected to the air blower 16. The air introduction pipe 17 is branched to provide a first pipe connected to a first control valve 18 and a second pipe connected to a second control valve 19. The first control valve 18 is connected to a cleaning pipe 20 which in turn is connected to the liquid evaporator 11 while the second control valve 19 is connected to a preheating pipe 21 which in turn is connected to the deodorizing unit 14.

Figure 3:
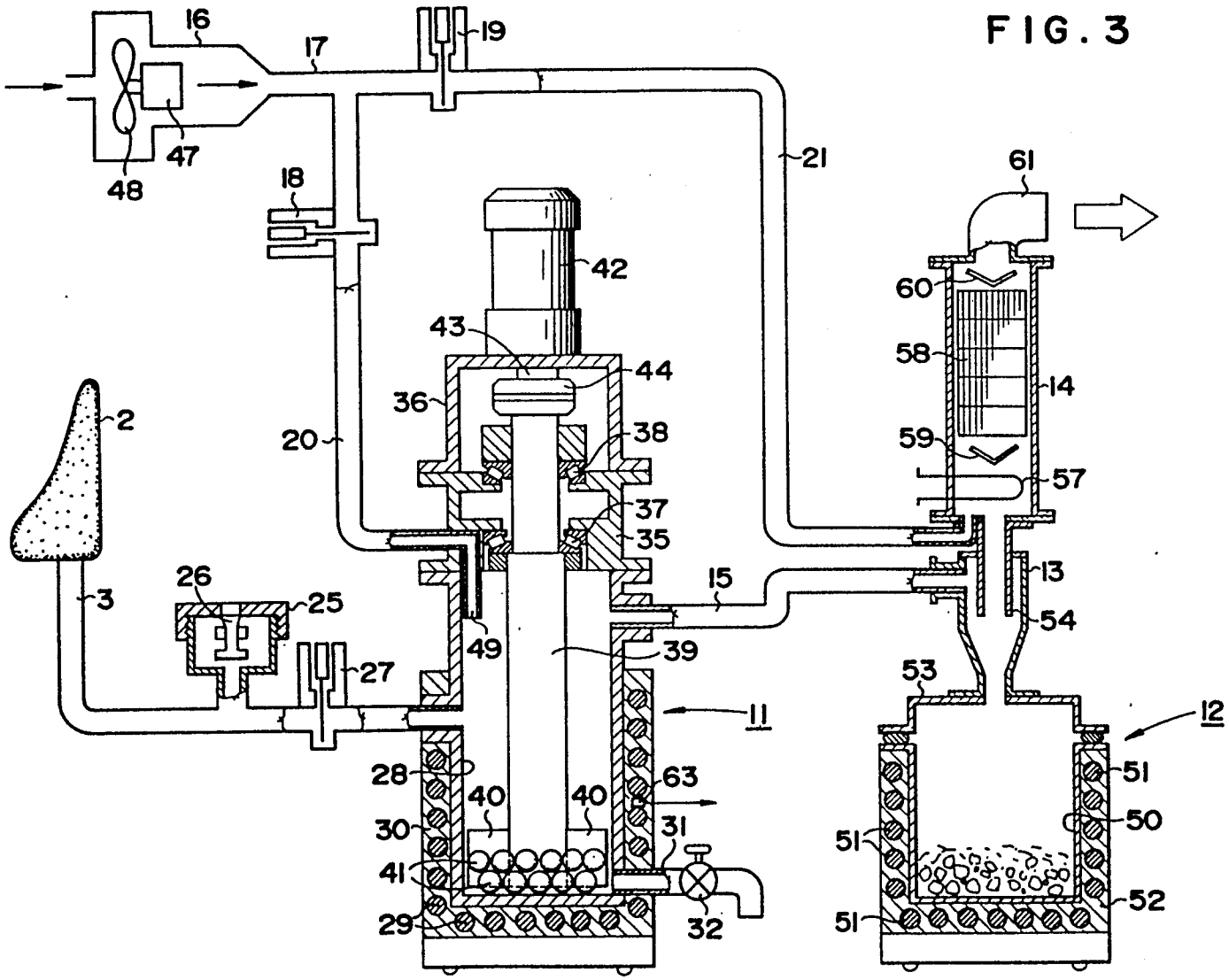
FIG. 3 is a view of the piping system showing the connections of each element of the raw sewage disposal apparatus of FIG. 1.

Referring to FIG. 3, a tank chamber 25 is provided in the middle portion of the introduction pipe 3 for storing overflow liquid in said chamber. The tank chamber 25 has a liquid sensor 26 therein for detecting the overflow of the liquid. A third control valve 27 is provided in the pipe 3 between the tank chamber 25 and the liquid evaporator 11.

The liquid evaporator 11 has an evaporation cauldron 28 at the lower half thereof. The cauldron 28 is formed of a heat-resistant material, such as stainless steel and the like. The evaporation cauldron 28 is connected to the introduction pipe 3 at the central side surface thereof and is connected to the discharge pipe 15 at the upper side surface thereof. Heating coils 29 are wound around the side surfaces and the bottom of the evaporation cauldron 28. A heat insulating member 30 surrounds the heating coils 29 at the periphery of the evaporator cauldron 28 for preventing heat from dissipating outside the evaporation cauldron 28. A temperature sensor 63 is embedded in the heat insulting material at a location close to the side surface of the evaporation cauldron 28 for detecting the temperature in the evaporation cauldron 28. A drain pipe 31 is connected to the bottom of the evaporation cauldron 28. A cock 32 is attached to the drain pipe 31 for temporarily discharging urine stored in the evaporation cauldron 28.

A cylindrical joint portion 35 is attached to an upper portion of the evaporation cauldron 28. A motor retainer 36 having a closed upper end and an open lower end covers the upper portion of the joint portion 35. With such an arrangement, the inside of the evaporation cauldron 28 is hermetically sealed from the outside. Bearings 37 and 38 are provided at the upper and lower portions of the joint portion 35 for rotatably supporting a vertical rotary shaft 39. The rotary shaft 39 is elongated and cylindrical and extends to a location close to the bottom of the evaporation cauldron 28. The rotary shaft 39 has stirring blades 40 fixed to the lower circumference thereof at two diametrically opposed portions thereof. A plurality of freely and independently movable heat holding bodies 41 are placed in the evaporation cauldron 28 and are movable therein by rotation of the stirring blades 40. The heat holding bodies 21 are made of a high heat holding material, such as alumina ($Al_2O_3$), pumice and the like.

A motor 42 is fixed to the upper surface of the motor retainer 36 and has an output shaft 43 which extends inside the motor retainer 36 and is connected to the upper end of the rotary shaft 39 by means of a joint 44. With this arrangement, the output of the motor 42 is transmitted to the rotary shaft 39 by means of the output shaft 43, thereby rotating the stirring blades 40 inside the evaporation cauldron 28.

Housed in the air blower 16 are a motor 47 and a fan 48, which is rotated by the motor 47. One of the branches of the air introduction pipe 17 is connected to the cleaning pipe 20 by way of the first control valve 18. The tip end of the cleaning pipe 20 enters inside the evaporation cauldron 28 by way of the joint portion 35 and forms a nozzle 49 directed toward the bottom of the evaporation cauldron 28. The other branch of the air introduction pipe 17 is connected to the preheating pipe 21 by way of the second control valve 19. The tip end of the preheating pipe 21 is connected to the lower portion of the deodorizing unit 14.

The tip end of the discharge pipe 15 is connected to the side surface of the dust collector 13. The dust collector 13 is connected to the collector box 12 which temporarily stores only the dust that has been separated from the air. The collector box 12 has a metallic dust box 50 on the inside thereof. The dust box 50 has an open upper end and a closed lower end forming the bottom thereof. A heater 51 is wound around the periphery of the dust box 50. Both the heater 51 and the dust box 50 are surrounded by a heat-insulating material 52 for preventing the heat from dissipating outside the dust box 50. A cover 53 is brought into contact with the upper open end of the dust box 50 for closing same. The lower open end of the dust collector 13 is connected to the cover 53. A vertical separation pipe 54 is provided in the dust collector 13 at the central portion thereof for flowing the separated air, alone, upwardly therethrough. The tip end of the separation pipe 54 is connected to the bottom of the deodorizing unit 14.

The deodorizing unit 14 oxidizes the bad smell components, such as ammonia, urea and bromine, contained in the discharged vapor, thereby eliminating the bad smell. The deodorizing unit 14 is cylindrical and hollow inside thereof and has a secondary heater 57 at the lower portion thereof. The deodorizing unit 14 further includes a honeycomb catalyst bed 58 which fills the middle portion thereof and is disposed above the secondary heater 57. Rectifier plates 59 and 60 are provided above and below the upper and lower ends of the catalyst 58. An L-shaped duct 61 is attached to the upper portion of the deodorizing unit 14 for diffusing air outside the deodorizing unit 14.

Figure 4:
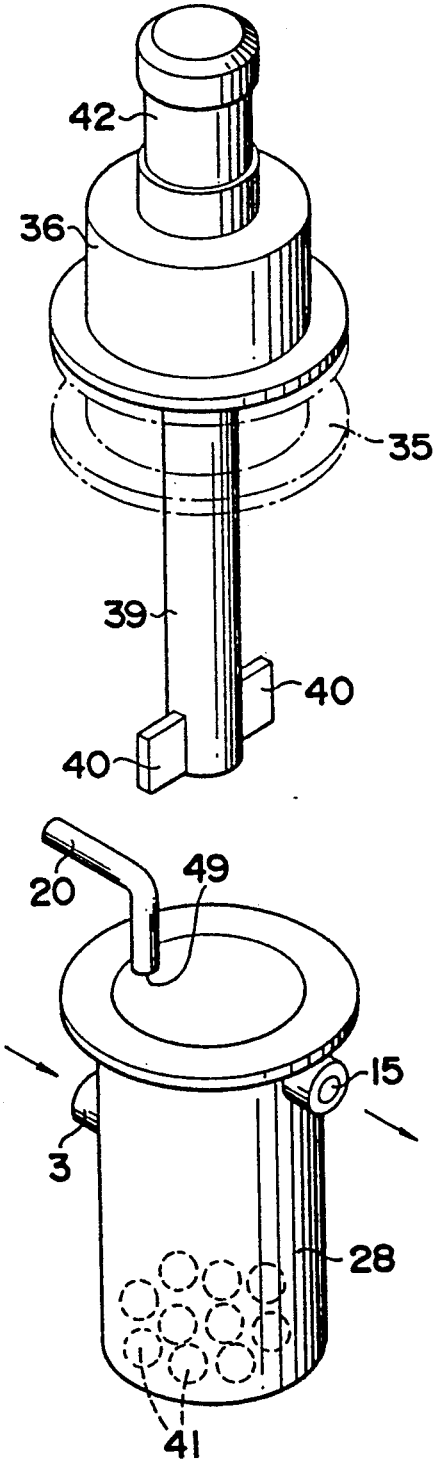
FIG. 4 is an exploded perspective view showing the casing and the drive means of FIG. 2.

The detailed structure of the evaporation cauldron 28, the joint portion 35 and the motor retainer 36 is illustrated in FIG. 4.

Figure 5:
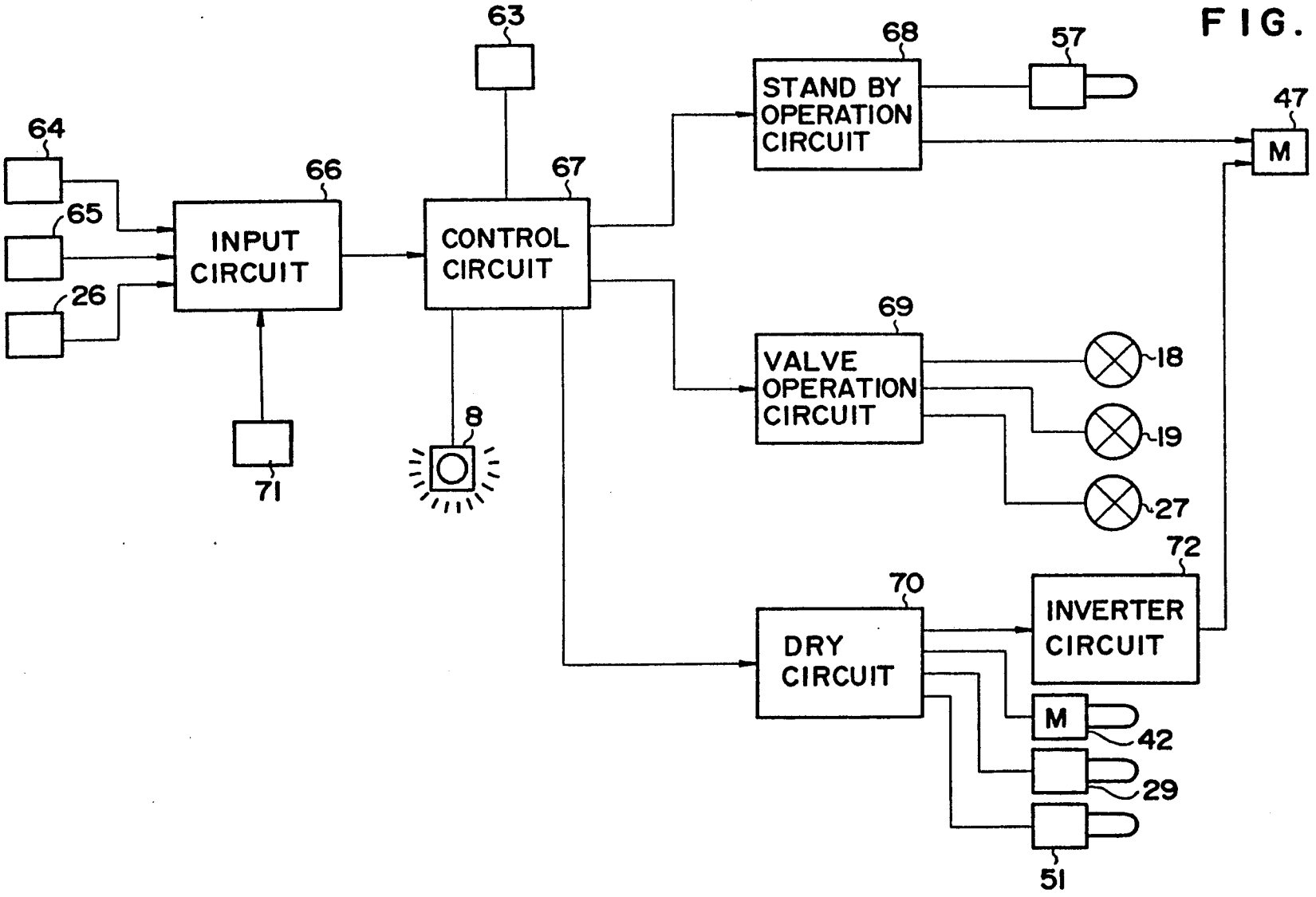
FIG. 5 is a circuit diagram of the control system of the first embodiment.
Figure 6:
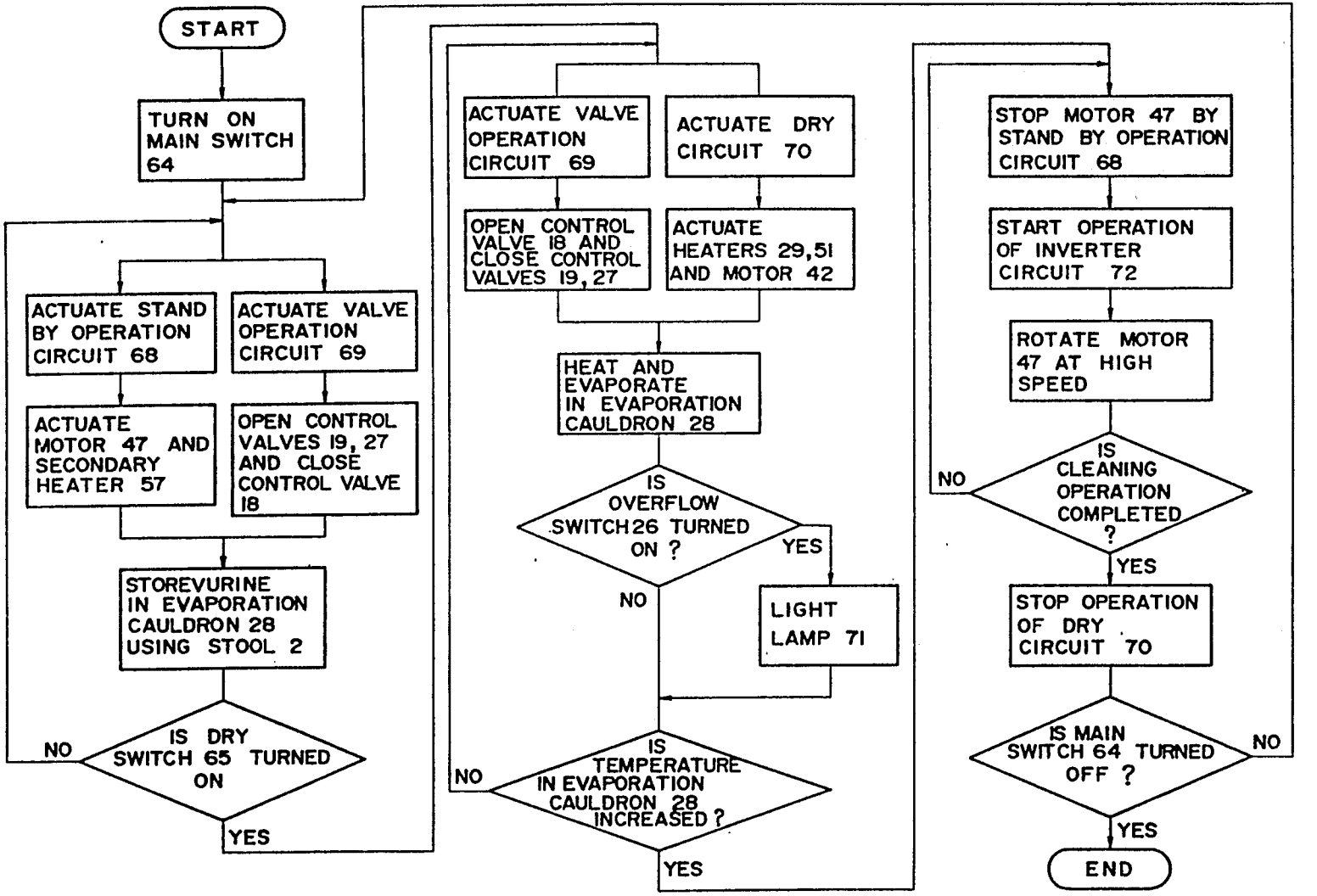
FIG. 6 is a flow chart for explaining the operation of the first embodiment.
Figure 7:
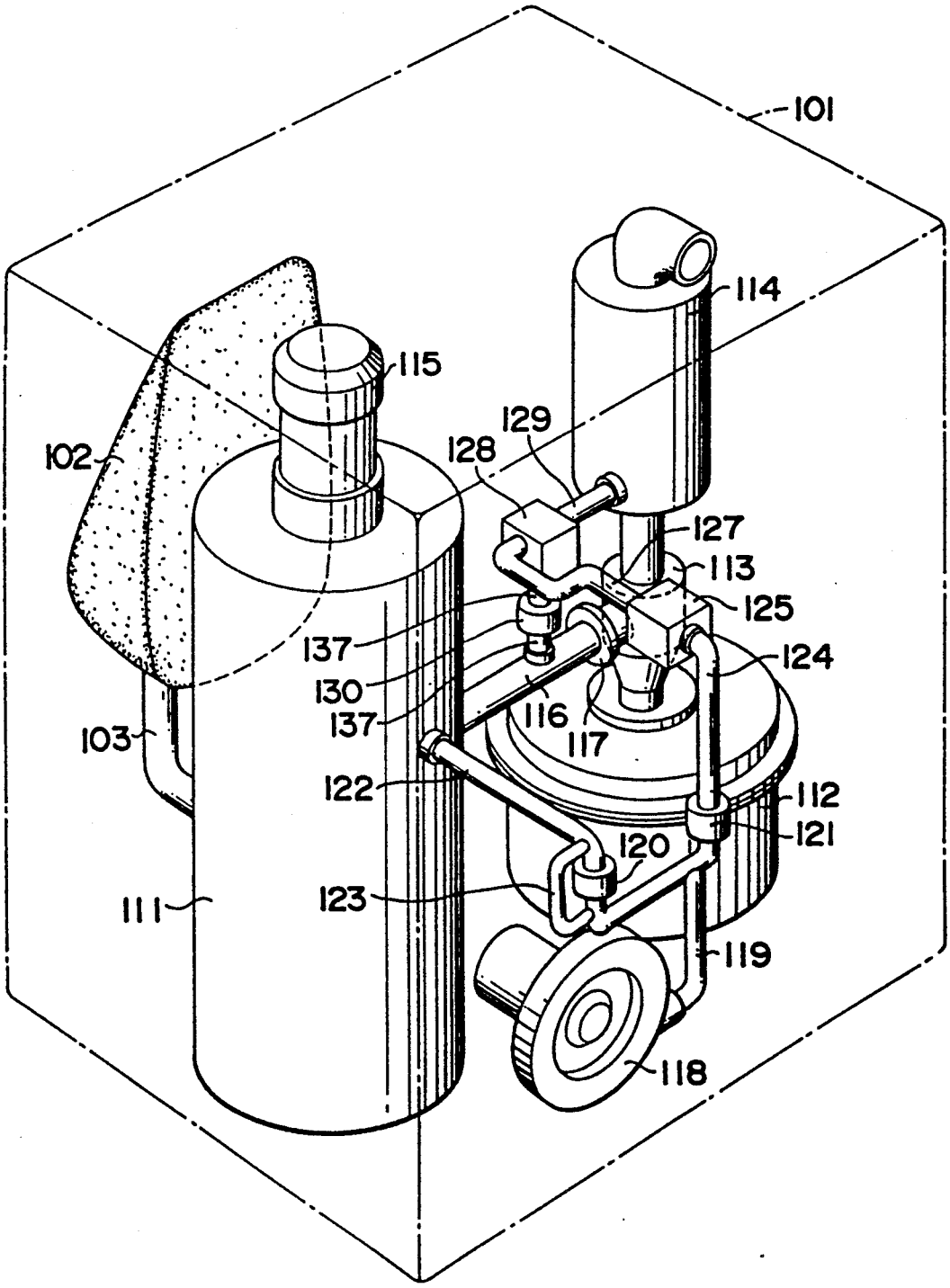
FIG. 7 is a perspective view showing the internal structure of a raw sewage disposal apparatus according to a second embodiment of the present invention.

FIG. 5 shows a circuit diagram of the control system of the first embodiment.

An input circuit 66 for receiving control signals has its input terminals connected to a main switch 64, an evaporation switch 65 and a liquid level sensor 26 and its output terminal is connected to a control circuit 67. An input terminal of the control circuit 67 is connected to a temperature sensor 63 and its output terminals are connected to a standby operation circuit 68, a valve operation circuit 69, a dry operation circuit 70 and a lamp or a press button 8 for indicating nonuse of the apparatus 1.

The output terminals of the standby operation circuit 68 are connected to the secondary heater 57 and the motor 47 of the air blower 16. The output terminals of the valve operation circuit 69 are connected to the first, second and third control valves 18, 19, 27. The output terminals of the dry operation circuit 70 are connected to an inverter circuit 72, the motor 42 and the heaters 29 and 51. An output terminal of the inverter circuit 72 is connected to the motor 47.

The operation of the raw sewage disposal apparatus, according to the first embodiment of the present invention, will be described hereinafter.

The apparatus 1 should be in standby status before operation thereof.

The main switch 64 is pressed to give instruction to the control circuit 67 for operating the apparatus 1.

The control circuit 67, upon reception of the instruction from the main switch 64, issues a signal to the standby operation circuit 68 so that the secondary heater 57 is energized and the motor 47 is driven. At the same time, the control circuit 67 issues a signal to the valve operation circuit 69 for opening the second control valve 19 and closing the first control valve 18 and the third control valve 27. If the press button 71 is operated at the time when the stool 2 is used, the third control valve 27 is opened for a short period of time so that urine can flow into the cauldron 28.

In this state, air is supplied by the fan 48, which is rotated by the motor 47, into the deodorizing unit 14 by way of the air introduction pipe 17 and the preheat pipe 21. Hot air generated by the secondary heater 57 flows toward the catalyst 58 together with air from the preheat pipe 21 to thereby heat the catalyst 58 when the same air is supplied into the deodorizing unit 14. At this time, the motor 47 is rotated at a low speed. The catalyst 58 is heated because the catalyst 58, such as platinum and the like, does not subject ammonia, bromine and the like to oxidation unless the catalyst is maintained at a temperature exceeding a predetermined temperature. When ammonia, bromine and the like pass through the catalyst at a low temperature, air having a bad smell is diffused from the duct 61. To prevent the bad smell from diffusing from the duct 61, air is supplied from the air blower 16 to the deodorizing unit 14 through the preheat pipe 21 so that the catalyst 58 is always kept warm and in standby status.

The third control valve 27 is temporarily opened when the presser button 71 (or the evaporation switch 65) is pressed in case of using the stool 2 so that the urine discharged into the stool 2 is introduced into the evaporation cauldron 28 by way of the introduction pipe 3.

Since the first control valve 18 is closed, air from the air blower 16 does not flow into the evaporation cauldron 28 so that the bad smell from the evaporation cauldron 28 is not diffused outside from the introduction pipe 3.

The cock 32 connected to the evaporation cauldron 28 is manually closed. The cock 32 is opened when the urine present in the evaporation cauldron 28 is discharged in case of improper operation of the apparatus 1. The cock 32 is not used normally.

Use of the apparatus in the standby state is made first by discharging the urine into the stool 2. The urine received in the stool 2 is introduced into the evaporation cauldron 28 and stored successively in the evaporation cauldron 28.

When the amount of urine stored in the evaporation cauldron 28 exceeds a predetermined amount, the thus-stored urine should be processed. The process is started by pressing the evaporation switch 65 (or the press button 71) for instructing the input circuit 66 to dry the urine. Although the evaporation switch 65 (or the press button 71) is manually pressed according to the first embodiment, an evaporation operation signal may also be supplied into the control circuit 67, by way of the input circuit 66, by means of a timer which supplies a signal for starting the evaporation operation at fixed time intervals, for example, hourly. Also, an infrared ray sensor can be provided at the front surface of the stool 2 for counting the number of uses of the stool 2 whereby the evaporation operation instruction is supplied into the input circuit 66 in case the actually counted number exceeds a preselected number.

When the evaporation switch 65 is pressed or the evaporation operation signal is given in some different way, the evaporation operation signal is supplied to the control circuit 67 by way of the input circuit 66. At this time, the secondary heater 57 and the motor 47 operate in the same way as they operate before the evaporation operation signal is issued. However, the evaporation operation signal is supplied from the control circuit 67 to the valve operation circuit 69 and the dry operation circuit 70.

The valve operation circuit 69, upon reception of the evaporation operation signal, opens the first control valve 18 and closes the second control valve 19 and the third control valve 27. Air flowing into the preheat pipe 21 is switched to the cleaning pipe 20 and is introduced into the evaporation cauldron 28 through the nozzle 49. Air is introduced into the upper end of the evaporation cauldron 28 for pushing vapor remaining in the evaporation cauldron 28 out of the evaporation cauldron 28 and facilitating the oxidation of the vapor. The third control valve 27 is closed for preventing the bad smell in the vapor from flowing out of the stool 2 by way of the introduction pipe 3. At the same time, the evaporation operation circuit 70 actuates the motor 42 and energizes the heaters 29 and 51.

When the heater 29 is energized, the heater generates heat to heat the evaporation cauldron 28 from the outside of the evaporation cauldron 28 to evaporate the stored urine.

When the motor 42 is actuated, the rotation of the output shaft 43 is transmitted to the rotary shaft 39 by way of a coupling 44 whereby the rotary shaft 39 and the stirring blades 40 ar rotated. By the rotation of the stirring blades 40, the heat holding bodies 41 accommodated in the evaporation cauldron 28 are simultaneously agitated in order to stir the urine stored in the evaporation cauldron 28 so that the temperature of the urine rises uniformly. Since the heat holding bodies 41 store the heat from the heater 29, the urine is mixed with the heat holding bodies 41 and contacts the surfaces of the heat holding bodies 41 so that the heat of the heat holding bodies 41 is smoothly transmitted to the urine to expedite the rise of the temperature of the urine.

The urine in the evaporation cauldron 28, heated by the heater 29, starts evaporation when the temperature exceeds a given value. Inasmuch as the fresh air is supplied from the atmosphere through the cleaning pipe 20 and is introduced successively into the evaporation cauldron 28 through the nozzle 49, the vapor formed in the evaporation cauldron flows toward the dust collector 13 through the discharge pipe 15. The air including the vapor introduced into the dust collector 13 flows toward the deodorizing unit 14 by way of the separation pipe 54 (at this time, the air is jetted gently from the nozzle 49 so that a cyclonic flow of the air is not generated in the dust collector 13 whereby a fully effective dust separation operation does not yet occur).

Since the secondary heater 57 is heated as set forth above, the vapor including the bad smell component is reheated and flows toward the catalyst 58. The hot vapor reheated by the heater 57 contacts the catalyst 58, such as platinum, whereby the bad smell components, such as ammonia and bromine, are oxidized and become odorless and then are discharged outside from the duct 61. With the continuance of these operations, the vaporizable component of the urine in the evaporation cauldron 28 is successively evaporated, rendered odorless and is discharged outside.

When urine is discharged from the stool 2 while the third closing valve 27 remains closed, the urine is temporarily stored in the tank chamber 25. When the tank chamber 25 is filled with the urine, the liquid level sensor 26 is actuated to thereby supply a signal indicating that there is no capacity to store more liquid. The signal is supplied to the input circuit 66. When the signal is supplied to both the input circuit 66 and the control circuit 67, the lamp 8 provided at the front portion of the apparatus 1 is lighted to inform the user that the apparatus 1 is not usable at present.

When the evaporation operation continues for a predetermined time, the vaporizable component of the urine stored in the evaporation cauldron 28 is completely evaporated. The residual substances, such as waste matter and ash, which are not evaporated with the liquid component, remain in the cauldron in the form of powder. Since the heat holding bodies 41 are agitated by the stirring blades 40 the nonevaporable components are crushed into a fine powder. When the liquid component no longer remains in the evaporation cauldron 28, the temperature of the evaporation cauldron 28 rises sharply. The temperature sensor 63 detects the sharp rise of the temperature of the evaporation cauldron 28 and informs the control circuit 67 that no liquid component remains in the evaporation cauldron 28. The cleaning operation starts when the temperature sensor 63 detects the sharp rise of the temperature of the evaporation cauldron 28.

The standby operation circuit 68 stops supplying a low speed signal to the motor 47 while at the same time the dry circuit 70 supplies a signal to the inverter circuit 72 and also supplies a high speed signal to the motor 47. The rpm of the motor 47, upon reception of the high speed signal, is increased compared with that in the drying operation so that the motor 47 rotates the fan 48 at a high speed. As a result, the amount of air introduced by the air blower 16 is increased whereby the fresh air is forced into the air introduction pipe 17 and the cleaning pipe 20. Consequently, a large amount of air is jetted from the nozzle 49 which blows up the dust in the evaporation cauldron 28 and discharges the dust, together with air, from the discharge pipe 15. The dust-laden air discharged from the discharge pipe 15 is introduced into the dust collector 13 at a high speed wherein the air flows in a cyclonic or vertical path, as is conventional in cyclone dust collectors. The minute dust particles drop into the dust box 50 and accumulate therein. The air, having little or no dust suspended therein, passes through the separation pipe 54 and the deodorizing unit 14, and thereafter is diffused outside from the duct 61.

Since the thus-separated dust that remains in the dust box 50 contains a liquid component, more or less, the liquid component is evaporated by the heater 51 to form a vapor. The vapor is introduced into the deodorizing unit 14 by way of the separation pipe 54, is oxidized by the catalyst 58 and thereafter is discharged from the duct 61. Inasmuch as a large amount of air is introduced into the evaporation cauldron 28 by way of the cleaning pipe 20, the dust is moved together with the air and is discharged outside the evaporation cauldron 28. As a result, the cleaning operation is completed.

When a series of steps composed of evaporation and cleaning operations is completed, the apparatus 1 should be in a standby state for the next user. When the control circuit 67 judges that the cleaning operation is completed, the control circuit 67 issues a signal to the standby operation circuit 68 so that the motor 47 is rotated at a low speed. As a result, a small amount of the fresh air is introduced into the discharge pipe 17. At the same time, the valve operation circuit 69 closes the first closing valve 18 and opens the second and third closing valves 19 and 27. The dry operation circuit 70 stops its operation, thereby stopping the inverter circuit 72 and the motor 42 and both the heaters 29 and 51 are deenergized. By this operation, the apparatus 1 is placed in the standby state.

With the arrangement of the first embodiment, the cleaning of the dust, such as the waste matter, the ash and the like, which remains in the evaporation cauldron after the liquid component is evaporated, can be automatically carried out. Accordingly, it is not necessary to deassemble and clean the apparatus regularly so that the apparatus serves for a long time of use. Since the evaporation cauldron can be cleaned every time the evaporation operation of the urine is carried out, the inner portion of the evaporation cauldron can be always kept clean, thereby preventing trouble from occurring.

Second Embodiment (FIGS. 7 to 12)

A raw sewage disposing apparatus according to the second embodiment will be described with reference to FIGS. 7 to 12.

The raw sewage disposing apparatus 101 comprises a cylindrical evaporation cauldron 111 and a dust collector 113 disposed alongside the evaporation cauldron 111. The cyclone dust collector 113 (hereinafter referred to as simply dust collector) is mounted on the upper surface of the dust box 112 and a cylindrical catalyst box 114 is disposed above the dust collector 113. A urine introduction pipe 103 is connected between the central side surface of the evaporation cauldron 111 and a stool 102. A discharge pipe 116 is connected to a side surface of the evaporation cauldron 111 opposite to the urine introduction pipe 103 and extends toward the dust collector 113. The discharge pipe 116 has a tip end connected to the dust collector 113 by way of a first closing valve 117. The apparatus 101 has an air blower 118 at the lower portion thereof. The air blower 118 has an air introduction pipe 119 which is branched into a first part provided with a second closing valve 120 and a second part provided with a third closing valve 121. The second closing valve 120 is connected to a cleaning pipe 122 which has a tip end connected to the side surface of the evaporation cauldron 111. A restriction pipe 123 is interposed in the cleaning pipe 122 so as to bypass the second closing valve 120 for controlling the amount of air that flows into pipe 122 to an appropriate value. A connection pipe 124 is connected to the third closing valve 121 and has a tip end connected to a secondary heat box 125. The secondary heat box 125 has a heated output side connected to a preheat pipe 127. The preheat pipe 127 has a tip end connected to an ejector 128 which is restricted inside thereof. A pipe 129 is connected to an output side of the ejector 128 and has a tip end connected to the lower side surface of the catalyst box 114. A bypass 137 is connected between a part of the discharge pipe 116 upstream of the valve 117 and a negative pressure side on the ejector 128. A fourth closing valve 130 is interposed midway in the bypass pipe 137.

Figure 8:
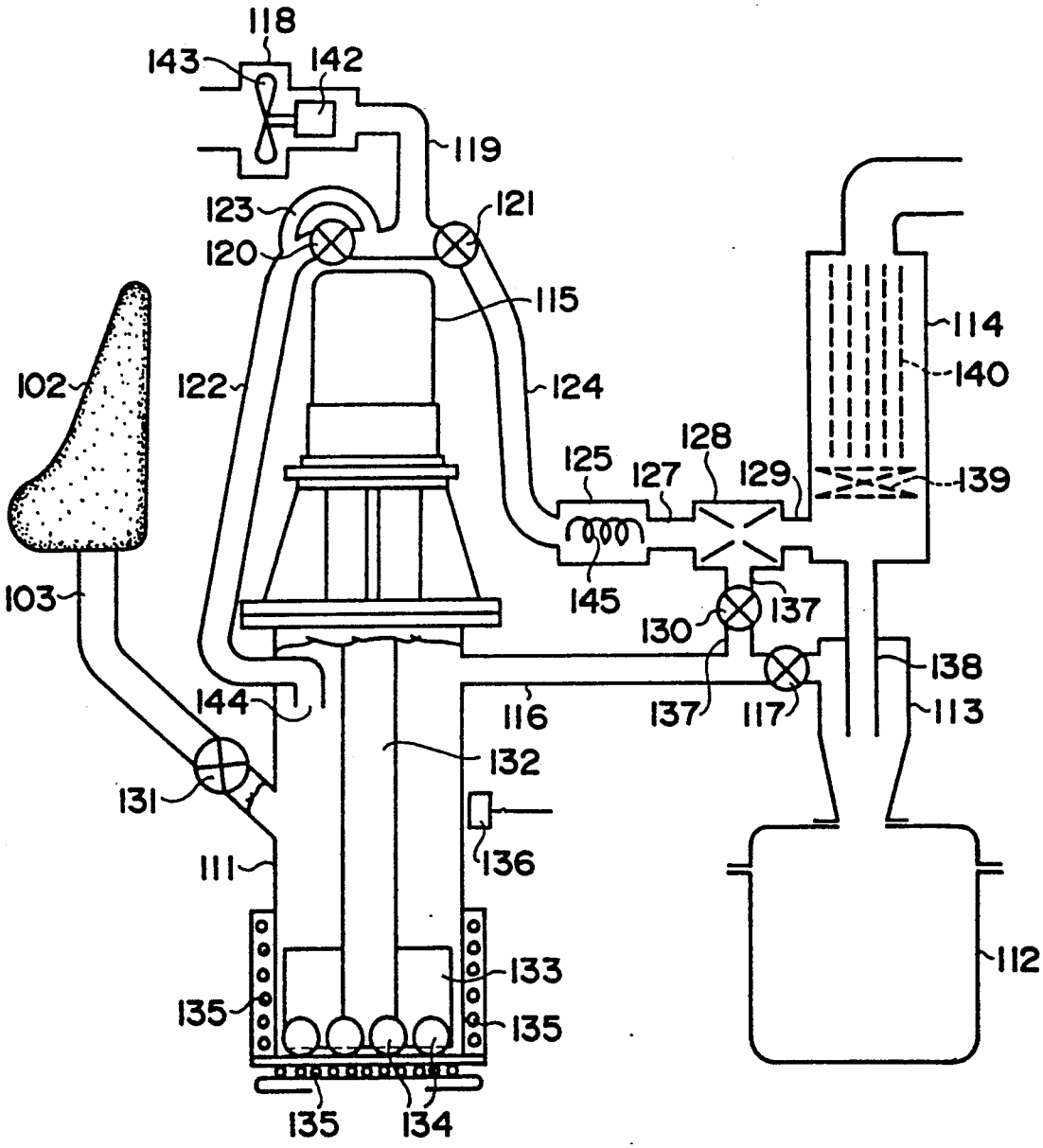
FIG. 8 is a view of the piping system showing connection of each element of the raw sewage disposal apparatus of FIG. 7.

FIG. 8 shows the piping system including the connections between the evaporation cauldron 111, the dust box 112 and the catalyst box 114.

A fifth closing valve 131 is provided midway in the urine introduction pipe 103 connected to the stool 102 while the tip end of the urine introduction pipe 103, downstream of the fifth closing valve 131, is connected to a substantially central side surface of the evaporation cauldron 111. The evaporation cauldron 111 is cylindrical and is closed at the lower portion thereof and is formed of a metallic heat-resistant material. The discharge pipe 116 is connected to the upper side surface of the evaporation cauldron 111 and has a tip end connected to the dust collector 113 by way of the first closing valve 117. Heating coils 135 are wound around the bottom surface and lower periphery of the evaporation cauldron 111. A temperature sensor 136 is connected to the side surface of the evaporation cauldron 111 for detecting the change of temperature of the evaporation cauldron 111. A drive mechanism 115 housing a motor and the like therein is placed on the evaporation cauldron 111 so that the upper opening of the evaporation cauldron 111 is closed. Accordingly, there is defined a chamber in the evaporation cauldron 111 which is shut off from the outside and is airtight. A long cylindrical rotary shaft 132 extends downwardly from the central portion of drive mechanism 115 and has stirring blades 133 fixed at the lower portion thereof which blades are located close to, but spaced upwardly of the inner surface of the bottom of the evaporation cauldron 111. A plurality of spherical, freely movable, heat holding bodies 134 are stored in the evaporation cauldron 111 and are agitatable therein by the stirring blades 133. The heat holding bodies 134 are formed of materials having high heat holding property, such as alumina ($Al_2O_3$), pumice and the like.

The air blower 118 has inside thereof a motor 142 and a fan 143 which is rotatable by the motor 142. The cleaning pipe 122 connected to the second closing valve 120 extends inside the evaporation cauldron 111 and has a tip end defining a nozzle 144 which opens downwardly. The restriction pipe 123 is disposed around the section of the cleaning pipe 122 containing the valve 120 and has a small cross sectional area so that the restriction pipe serves as a bypass of the second closing valve 120. The connection pipe 124 has a tip end connected to the secondary heat box 125 which has a hollow inside. The secondary heat box 125 houses a secondary heater 145 for heating the air supplied from the air blower 118. The preheat pipe 127 is connected between the output side of the secondary heat box 125 and the input side of the ejector 128.

The discharge pipe 116 and the suction side of the ejector 128 are connected by the bypass pipe 137. The fourth closing valve 130 is located in the bypass pipe 137.

The air supplied to the dust collector 113 when the valve 117 is open, flows in a cyclonic path, so that any dust in the air supply is separated from the air. The dust collector 113 has a separation pipe 138 disposed at the central portion thereof and the pipe extends upwardly and communicates with the bottom of the catalyst box 114. The catalyst box 114 has a filter 139 disposed at the lower portion thereof and a catalyst bed 140, such as platinum and/or palladium, which catalyst is disposed in the space above the filter 139.

Figure 9:
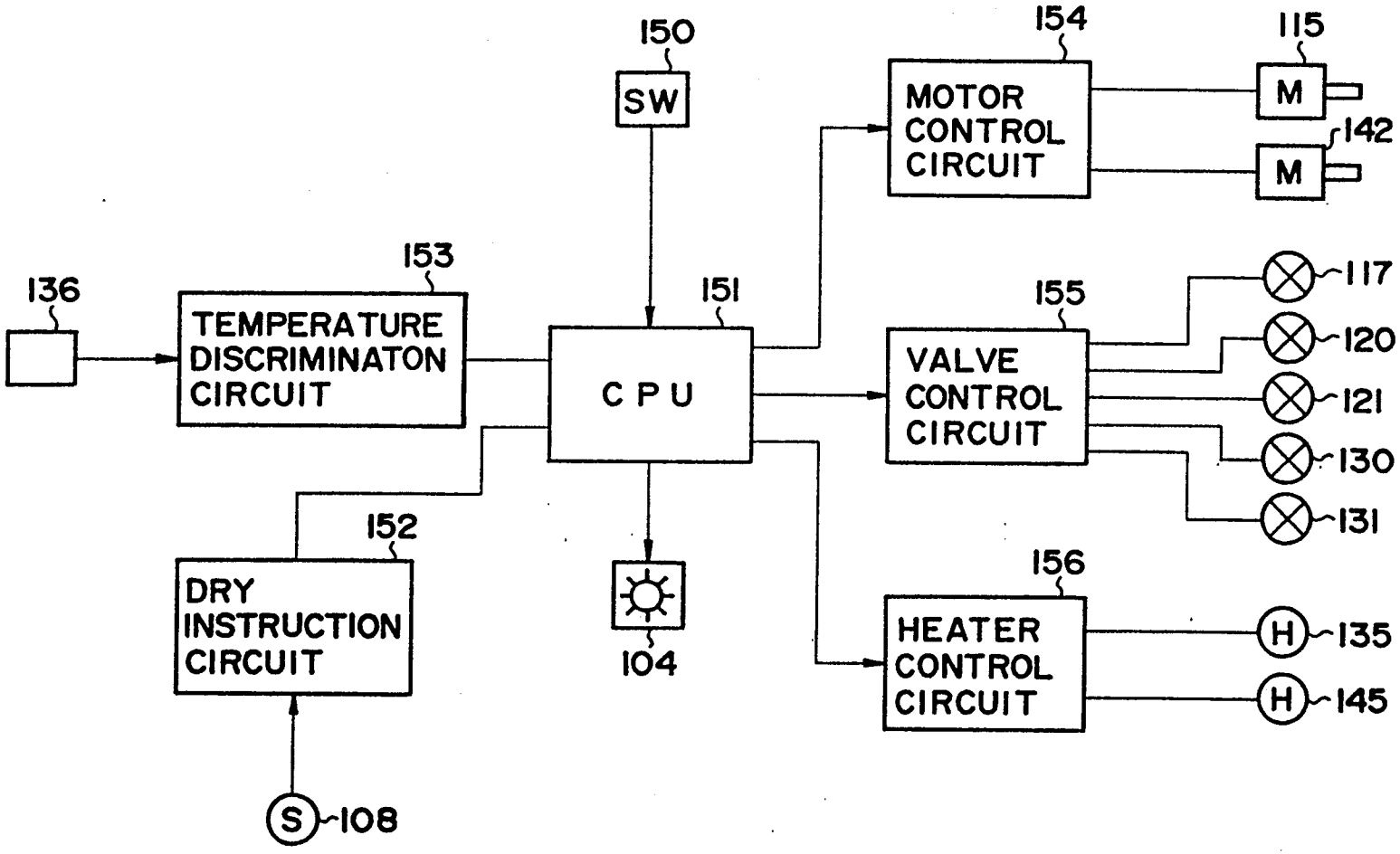
FIG. 9 is a circuit diagram of the control system of the second embodiment.
Figure 10:
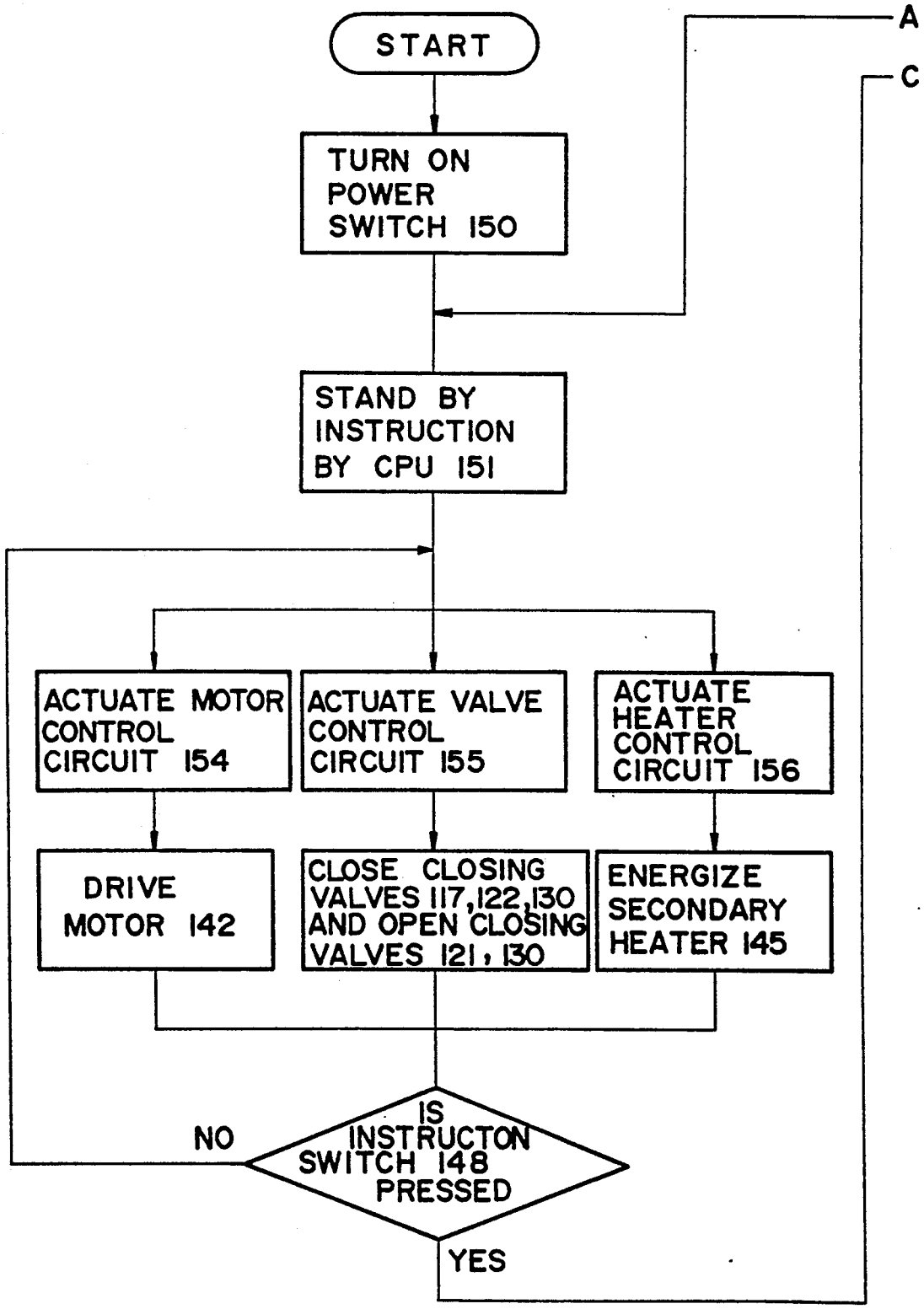
FIGS. 10 to 12 are flowcharts for explaining the operation of the second embodiment.
Figure 11:
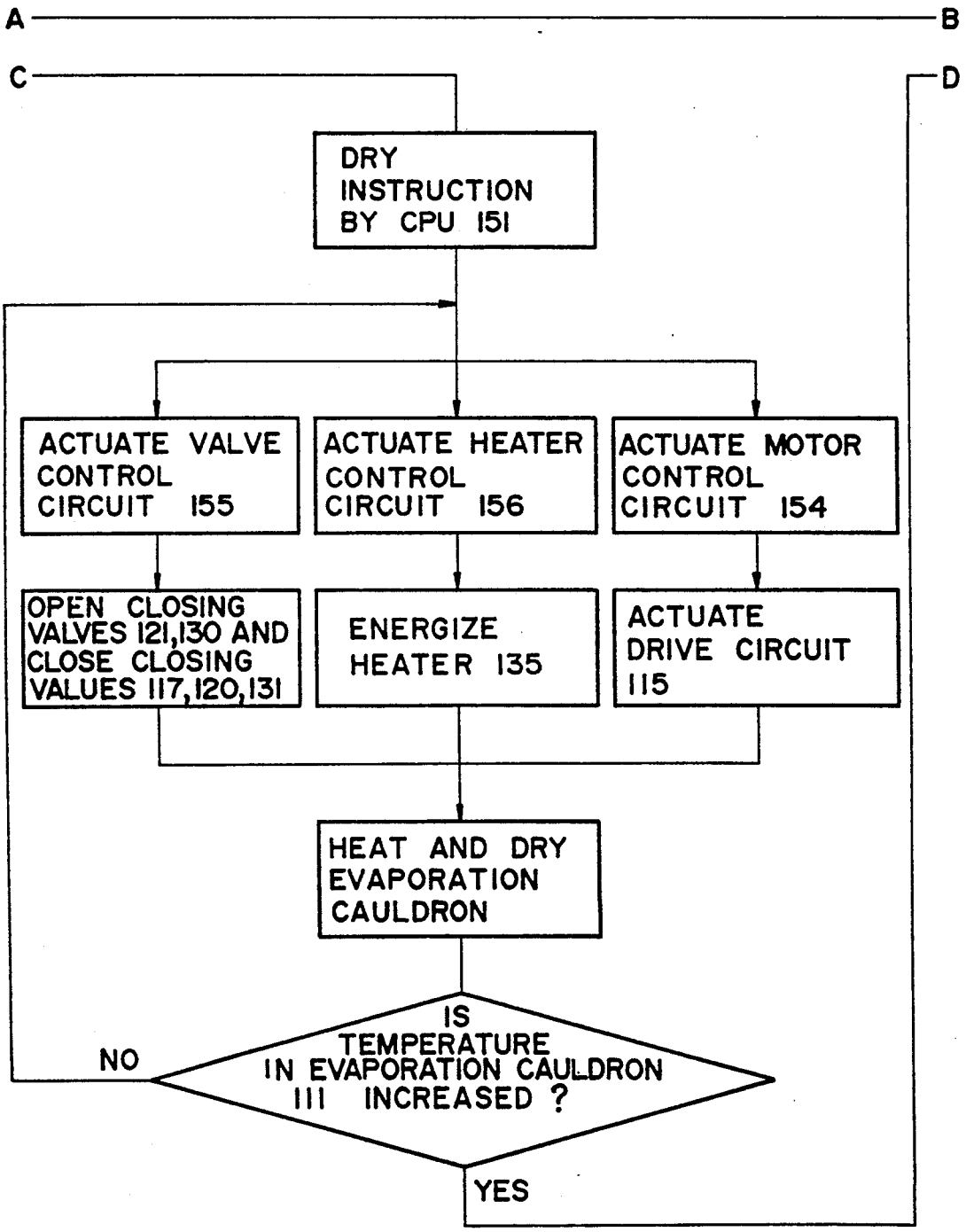
Figure 12:
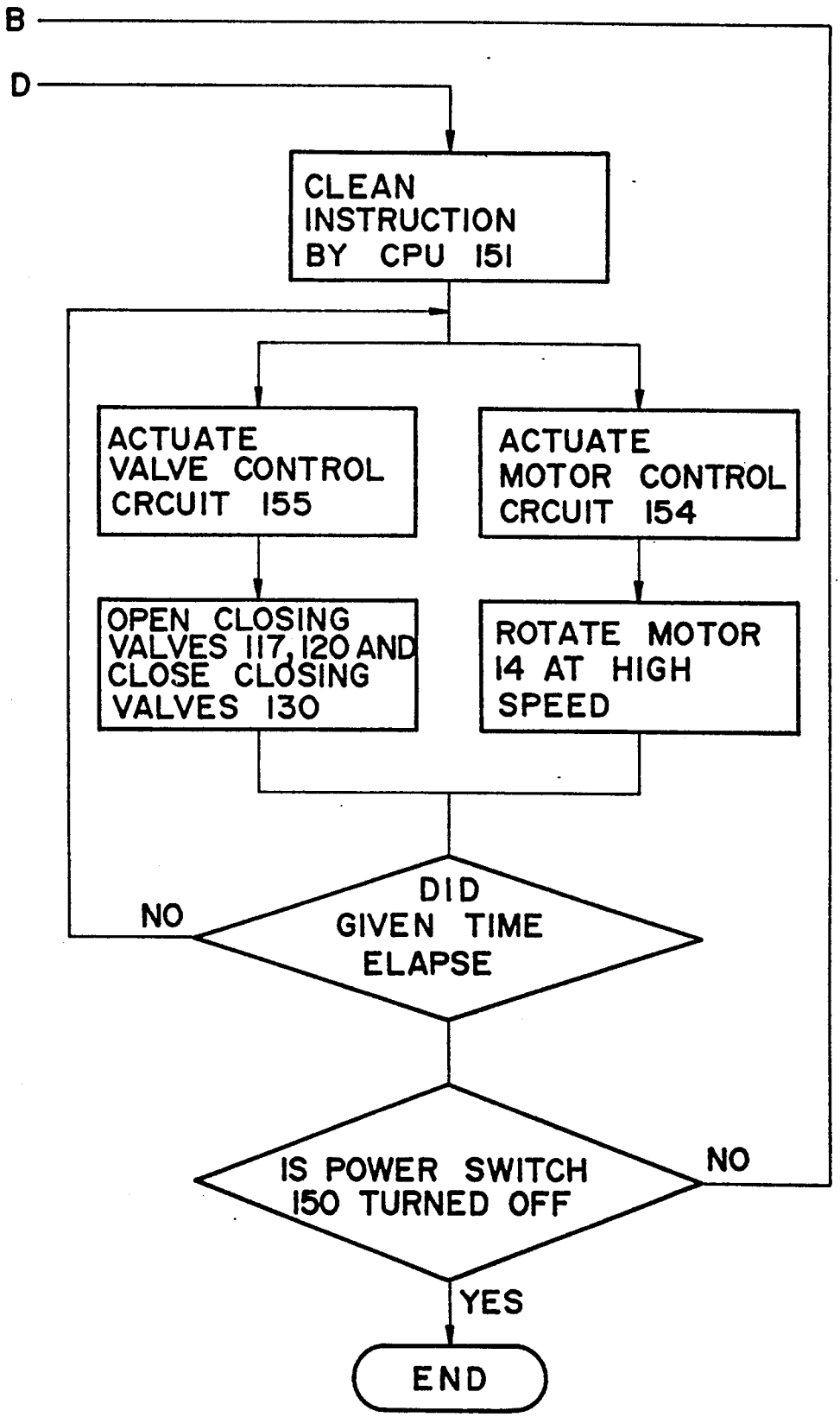

A control system according to the second embodiment will be described with reference to FIG. 9.

An instruction switch 108 provided at the front portion of the apparatus 101 has an output connected to a dry instruction circuit 152 which has an output connected to a central processing unit (hereinafter referred to as CPU) 151. An output of the temperature sensor 136 is connected to a temperature discrimination circuit 153 which has an output connected to the CPU 151. A power switch 150 is connected to the CPU 151 for starting the whole operation of the apparatus 101. The CPU 151 has outputs connected to a lamp 104, a motor control circuit 154, a valve control circuit 155 and a heater control circuit 156. The lamp 104, the motor control circuit 154, the valve control circuit 155 and the heater control 156, respectively, receive instructions from the CPU 151 to thereby control each component thereof. The drive mechanism 115 and a motor 142 are connected to the motor control circuit 154. The first to fifth closing valves 117, 120, 121, 130 and 131 are respectively connected to the valve control circuit 155. The heater 135 and the secondary heater 145 are respectively connected to the heater control circuit 156.

The operation of the second embodiment will be described hereinafter.

First, to establish the standby status of the apparatus, the power switch 150 is turned on to enable the CPU 151 to instruct each component of the apparatus 101. The instruction is supplied to the lamp 104, the motor control circuit 154, the valve control circuit 155 and the heater control circuit 156. The motor control circuit 154, upon reception of the instruction from the CPU 151, actuates the motor 142 to thereby rotate the fan 143 and introduce the fresh air into the air introduction pipe 119. The valve control circuit 155, upon reception of the instruction from the CPU 151, opens the third and fifth closing valves 121 and 131 and closes the second, first and fourth closing valves 120, 117 and 130. The heater control circuit 156, upon reception of the instruction from the CPU 151, energizes the secondary heater 145 which heats the air passing through the secondary heat box 125. At this state, the fresh air is drawn from the atmosphere by the fan 143 and supplied to the ejector 128 by way of the air introduction pipe 119, the third closing valve 121, the connection pipe 124, the secondary heat box 125 and the preheat pipe 127 and further passes through the catalyst box 114 and finally is discharged toward the atmosphere whereby an air flow route is formed between the inlet from the air blower 118 to the outlet of the catalyst box 114. At this time, the secondary heater 145 is energized and heated so that the flowing air can be heated by the secondary heater 145. The heated air heats the catalyst 140 when it passes through the catalyst box 114 to thereby maintain the temperature of the catalyst so that the catalyst 140 can subject the vapor to the oxidation-reduction.

The apparatus 101 can be used while it is in the standby state described above. The apparatus 101 can store the discharged urine in such a manner that the discharged urine is first received by the stool 102 and stored, then passed through the urine introduction pipe 103, the fifth closing valve 131 and finally is stored in the evaporation cauldron 111. The one time disposing capacity of urine in the apparatus 101 is determined by the volume of the evaporation cauldron 111.

When the evaporation and drying operation is to be carried out, the instruction switch 108 is pressed so that the urine in the evaporation cauldron 111 can be evaporated when it is judged that the predetermined amount of urine is stored in the evaporation cauldron 111 and no more urine can be stored. An instruction signal issued by the instruction switch 108 is supplied to the dry instruction circuit 152. The dry instruction circuit 152, upon reception of the instruction from the switch 108, issues a signal that the evaporation can be effected because the predetermined amount of urine is stored in the cauldron 111. This signal is supplied to the CPU 151. The CPU 151, upon reception of the signal from the dry instruction circuit 152, supplies a signal to the motor control circuit 154, the valve control circuit 155 and the heater control circuit 156 so that they can start the drying operation.

Firstly, the motor control circuit 154 actuates the drive mechanism 115 so that the motor 142 is driven whereby the rotary shaft 132 and the stirring blades 133 are respectively rotated in the evaporation cauldron 111, which also involves the agitation of the heat holding bodies 134. The temperature of the stored urine is kept constant because of the rotation of the stirring blades 133 and agitation of the heat holding bodies 134 in the evaporation cauldron 111. At the same time, the valve control circuit 155 opens the fourth closing valve 130 and closes the fifth closing valve 131 while the third closing valve 121 is kept opened (at this time, the first closing valve 117 and the second closing valve 120 are kept closed). The fresh air from the air blower 118 passes through the air introduction pipe 119, the third closing valve 121, the connection pipe 124, the secondary heat box 125, the preheat pipe 127, the ejector 128 and the supply pipe 129 and is introduced into the catalyst box 114, and then is diffused to the atmosphere. At this time, a negative pressure is generated at the side of the bypass pipe 137, caused by the air that passes through the ejector 128, so that the air in the discharge pipe 116 is drawn into the ejector 128 by way of the fourth valve 130. Accordingly, drawn into the ejector 128 is the fresh air which passes through the air introduction pipe 119, the restriction pipe 123 and the cleaning pipe 122 and is introduced into the evaporation cauldron 111, so that a second air flow route is provided in addition to the first air flow route provided by the connection pipe 124. Inasmuch as the inner diameter of the restriction pipe 123 is small in the second air flow route, the amount of air flowing in the second air flow route is less than that of the first air flow route. When the fresh air is introduced by way of the air blower 118, the oxidation of the urine stored in the evaporation cauldron 111 is facilitated. When the heater 135 is energized by the heater control circuit 156, the evaporation cauldron 111 is heated at the side and bottom thereof so that the urine stored in the evaporation cauldron 111 is boiled.

The urine stored in the evaporation cauldron 111 is heated and boiled by the heater 135 when the heater control circuit 156 receives the instruction from the CPU 151 so that the liquid component of the urine is evaporated so as to be changed into a vapor. The vapor passes through the discharge pipe 116, the fourth closing valve 130, the bypass pipe 137 and is drawn into the ejector 128 by the air flow through the ejector 128 and then passes through the catalyst box 114. After passing through the catalyst box 114, the vapor is diffused into the atmosphere. Since the air heated by the secondary heater 145 flows within the secondary heat box 125, the vapor flowing from the bypass pipe 137 is mixed with the heated air and is reheated. As a result, although the temperature of the vapor formed in the evaporation cauldron 111 is reduced as it flows through the discharge pipe 116, the fourth closing valve 130 and the bypass pipe 137, the temperature of the vapor is increased when it is mixed with the hot air in the ejector 128. Accordingly, the vapor formed in the evaporation cauldron 111 contacts the catalyst 140 in the catalyst box 114 and is subjected to oxidation-reduction because it is heated to a sufficiently high temperature for the reaction to take place effectively. The vapor including the bad smell component, such as ammonia and bromine, contacts the catalyst 140 and is subjected to the oxidation-reduction reaction whereby it is changed into an odorless vapor and then is diffused into the atmosphere.

The rotary shaft 132 and the stirring blades 133 are rotated in the evaporation cauldron 111 by the drive mechanism 115 whereby the heat holding bodies 134 housed in the evaporation cauldron 111 at the bottom portion thereof are agitated by the stirring blades 133. The temperature of the urine stored in the evaporation cauldron 111 rises uniformly as a whole since the urine is stirred by the rotation of the stirring blades 133 and the heat holding bodies 134. Likewise, since the heat holding bodies 134 hold the heat therein, the urine contacts the surfaces of the heat holding bodies 134 by the rotation of the stirring blades 133 so that the heat held by the heat holding bodies 134 is transmitted to the urine which involves an increase of the temperature of the urine.

The liquid component constituting the main portion of the urine stored in the evaporation cauldron 111 is evaporated due to the heating operation by the heater 135 and the stirring operation by the stirring blades 133 and the heat holding bodies 134. There remains in the evaporation cauldron 111 solid residual substances, such as cellulose fibers. The residual substance is liable to adhere to the bottom of the evaporation cauldron 111 during long term usage thereof, which would hinder the drying operation. Accordingly, when the drying operation is completed, the residual substance remaining in the evaporation cauldron 111 and the dust must be removed so that the cauldron is cleaned. The cleaning operation is automatically made in succession when it is judged that all the urine in the evaporation cauldron 111 has been dried.

When the urine in the evaporation cauldron 111 is completely evaporated and dried, the temperature of the evaporation cauldron 111 at the side thereof rises. The rise of the temperature is detected by the temperature sensor 136 which issues a detection signal to the temperature discrimination circuit 153. The temperature discrimination circuit 153 issues a cleaning start operation signal to the CPU 151. The CpU 151, upon reception of the signal from the temperature discrimination circuit 153, lights the lamp 104 which indicates that the evaporation cauldron 111 is ready for a cleaning operation. The CPU 151 also issues the signal respectively to the motor control circuit 154, the valve control circuit 155 and the heater control circuit 156. The motor control circuit 154 supplies high frequency power to the motor 142 by way of an inverter whereby the rpm of the motor 142 is increased. The increase of rpm of the motor 142 rotates the fan 143 at a higher speed so that the amount of air introduced by the air blower 118 is increased. The valve control circuit 155 closes the fourth closing valve 130 and opens the second valve 120 and the first closing valve 117 (at this time, the third closing valve 121 remains open while the fifth closing valve 131 remains closed). As a result, the second air flow route is formed by the air introduction pipe 119, the second closing valve 120, the cleaning pipe 122 and the nozzle 144 whereby the air is forced to jet from the nozzle 144. The residual substance stored in the evaporation cauldron 111 is blown away by the high speed air jet introduced through nozzle 144. The residual substance and the dust blown up by the air jetted by the nozzle 144 passes through the discharge pipe 116 and the first closing valve 117 and thereafter is introduced into the dust collector 113. Since the outer casing of the dust collector 113 is restricted in a downward direction, the air flow is turned like a cyclone or vortex at high speed so that the particles of residual substance, which particles are heavier than the air, drop into the dust box 112 and air alone flows upwardly toward catalyst box 114 from the separation pipe 138 and thereafter is diffused into the atmosphere. As a result, the particles of residual substance are separated from the vapor by the dust collector 113. During this time, the drive mechanism 115 is operated continuously, thereby agitating the heat holding bodies 134 at the bottom of the evaporation cauldron 111. As a result, any residual substance that is adhered to the bottom and the inside portion of the evaporation cauldron 111 is crushed to become minute particles. There is also provided the first air flow route through which the fresh air flows by way of the third closing valve 121, the connection pipe 124, the secondary heat box 125, the preheat pipe 127 and the ejector 128. Because of the existence of the first air flow route, the temperature of the secondary heater 145 is prevented from rising sharply and from becoming damaged. After the cleaning operation has been carried out for a given time, the CPU 151 makes the judgment that the residual substance in the evaporation cauldron 111 has been eliminated and stops the cleaning operation.

As described above, the air is jetted from the nozzle 144 when the motor 142 is driven by the high frequency current from the inverter so that the residual substance in the evaporation cauldron 111 is blown out of the cauldron. Thereafter, the apparatus 101 is returned to the standby state for the next user. The CPU 151 supplies the signal to the motor control circuit 154, the valve control circuit 155 and the heater control circuit 156 so that all these circuits are switched to the standby state. The motor control circuit 154 returns the rpm of the motor 142 to the normal rpm, i.e., to the decreased rpm. Simultaneously, the rotation of the rotary shaft 132 by the drive mechanism 115 is stopped. The valve control circuit 155 closes the first, the second and the fourth closing valves 117, 120 and 130 and at the same time opens the fifth closing valve 131. Consequently, the stool 102 communicates with the inside of the evaporation cauldron 111 so that urine discharged toward the stool 102 is introduced into the evaporation cauldron 111. The heater control circuit 156 deenergizes the heater 135 while energizing the secondary heater 145.

The cycle of operations comprising the drying operation, the cleaning operation and the standby state operation can be repeated. Repetition of the cycle of operations enables the apparatus 101 to provide a long time period of usage. When the apparatus 101 is not to be used anymore or is to be stopped temporarily, the power switch 150 is operated to supply an instruction signal to the CPU 151. The CPU 151, upon reception of the instruction signal, stops the power supply to all the mechanisms, which causes termination of operation of the apparatus. The series of operations are illustrated in the flowcharts in FIGS. 10 to 12.

As mentioned above, according to the second embodiment, the air evaporated at the evaporation cauldron is drawn by the ejector, mixed with the hot air heated by the secondary heater at the ejector and is reheated by the hot air. The thus-heated hot air contacts the catalyst whereby the bad smell component is favorably subjected to the oxidation-reduction reaction. As a result, the bad smell component is rendered odorless and is diffused into the atmosphere. The secondary heater for heating the catalyst does not directly contact the vapor from the evaporation cauldron and is not provided at the vapor flow route. As a result, the secondary heater is neither oxidized nor deteriorated by the various components included in the vapor which assures the long time use of the secondary heater.

What is claimed is:

1. A raw sewage disposal apparatus comprising:

a heat-resistant vessel for containing raw sewage therein;

a first introduction pipe connected to said vessel for introducing raw sewage into said vessel;

heating means disposed for heating and drying the raw sewage in said vessel;

stirring means disposed in said vessel, said stirring means having a plurality of stirring blades for stirring the raw sewage;

a multitude of heat holding bodies contained in said vessel;

a second introduction pipe connected to said vessel for introducing fresh air, said second pipe having a nozzle through which air is jetted into said vessel;

a discharge pipe connected at one end thereof to said vessel for discharging the air in the vessel;

a dust collector connected to the other end of said discharge pipe for separating the dust from the air discharged from the vessel; and deodorizing means communicating with said dust collector and having therein a catalyst for removing the bad smell from the air.

2. A raw sewage disposal apparatus as claimed in claim 1, including a third introduction pipe for introducing air;

a secondary heating means connected at one end thereof to said third introduction pipe and having a secondary heater therein;

an ejector connected at one end thereof to the other end of said secondary heating means for generating a negative pressure therein and at the other end thereof to said deodorizing means; and a bypass pipe connected between said discharge pipe and a negative pressure side of said ejector and having a second closing valve therein.

3. An apparatus as claimed in claim 1 in which said vessel has a bottom wall and a sidewall and said heating means is mounted on both of said bottom wall and said sidewall of said vessel, said heat holding bodies are balls which are individually freely movable in said vessel, said nozzle extends through said sidewall close of the upper end thereof, said discharge pipe extending through said sidewall close of the upper end thereof and spaced from said nozzle so that an air stream can be discharged from said vessel through said discharge pipe, said dust collector being a cyclone separator for flowing the air stream when laden with dust through a spiral path, removing substantially dust-free air from the upper end of the central region of said separator and collecting dust at the bottom of said separator, said deodorizing means being connected for receiving air from said cyclone separator, said secondary heating means being disposed in a space between said cyclone separator and said deodorizing means, a third introduction pipe connected to said space so that fresh air can be heated by said secondary heating means and then flowed through said deodorizing means.

4. An apparatus as claimed in claim 3 including a source of pressurized fresh air and valve means for selectively directing the fresh air from said source to (1) said second introduction pipe, and (2) said third introduction pipe.

5. An apparatus as claimed in claim 1 in which said vessel comprises a casing having an opening in an upper portion thereof, a cover for covering said opening, heat insulating material on said casing; bearings fixed to the central portion of said cover, a drive shaft rotatably mounted coaxially on said bearings and penetrating vertically inside said casing, a drive mechanism connected to the upper portion of said drive shaft, said first pipe vertically penetrating said cover for introducing raw sewage into the interior of said inner casing.

6. An apparatus according to claim 4 including a storage vessel connected to said first introduction pipe and a valve connected to said first introduction pipe downstream of said storage vessel.

7. An apparatus as claimed in claim 2 in which said vessel has a bottom wall and a sidewall and said heating means is mounted on both of said bottom wall and said sidewall of said vessel, said heat holding bodies are balls which are individually freely movable in said vessel, said nozzle extends through said sidewall close of the upper end thereof, said discharge pipe extending through said sidewall close of the upper end thereof and spaced from said nozzle so that an air stream can be discharged from said vessel through said discharge pipe, said dust collector being a cyclone separator for flowing the air stream when laden with dust through a spiral path, removing substantially dust-free air from the upper end of the central region of said separator and collecting dust at the bottom of said separator, said deodorizing means being connected for receiving air from said cyclone separator, said secondary heating means being a heat box having a heating element therein, an inlet opening connected to said third introduction pipe and an outlet opening connected to the inlet of said ejector.

8. An apparatus as claimed in claim 7, including a source of pressurized fresh air and valve means for selectively directing the fresh air from said source to said second introduction pipe and said third introduction pipe.

9. An apparatus as claimed in claim 8 in which said vessel comprises a casing having an opening in an upper portion thereof, a cover for covering said opening, heat insulating material on said casing, bearings fixed to the central portion of said cover, a drive shaft rotatably mounted coaxially on said bearings and penetrating vertically inside said casing, and a drive mechanism connected to the upper portion of said drive shaft.

10. An apparatus according to claim 8 wherein said ejector comprises an ejector nozzle, means for flowing a jet of air from said secondary heating means at a high velocity through the central portion of said nozzle, said nozzle having a suction chamber surrounding the jet, said suction chamber being connected to receive air from said bypass pipe, and a venturi-shaped diffuser downstream of said suction chamber.

11. An apparatus according to claim 10 including a further valve in said discharge pipe downstream of said bypass pipe for selectively directing air flowing in said discharge pipe into said bypass pipe or into said dust collector.

12. An apparatus according to claim 11 including an additional valve in said second introduction pipe for closing same, and a second bypass of restricted area and connected in bypass relation to said additional valve.

* * * * *